US005594404A

United States Patent [19]

Happ et al.

[11] Patent Number: 5,594,404

[45] Date of Patent: Jan. 14, 1997

[54] FUSE ORIENTATION DEVICE

[75] Inventors: Lawrence R. Happ, Mundelein; Conrad F. Alfaro, Harwood Heights, both of Ill.; Bruce B. Grossmann, St. Louis, Mo.

[73] Assignee: Cooper Industries, Houston, Tex.

[21] Appl. No.: 212,836

[22] Filed: Mar. 15, 1994

[51] Int. Cl.[6] ..... H01H 85/22; H01H 85/50; H01H 85/30

[52] U.S. Cl. ..... 337/210; 337/213; 337/215; 337/208; 337/206

[58] Field of Search ..... 337/210, 213, 337/215, 218, 226, 231, 201, 202, 205, 208, 209, 214, 244, 227, 228, 251, 252, 236, 241; 439/830, 831, 832, 250, 366, 621, 622, 890

[56] References Cited

U.S. PATENT DOCUMENTS

| | | | |
|---|---|---|---|
| 3,293,393 | 12/1966 | Phelps . | |
| 3,299,236 | 1/1967 | Barker . | |
| 3,533,038 | 10/1970 | Gryctko | 337/226 |
| 3,585,558 | 6/1971 | Swain . | |
| 3,815,072 | 6/1974 | Dimarco | 337/226 |
| 3,879,696 | 4/1975 | Imajyo | 337/244 |
| 4,488,767 | 12/1984 | Lehman et al. . | |
| 4,768,978 | 9/1988 | Wettengel et al. . | |
| 4,782,317 | 11/1988 | Thwaites . | |
| 4,968,264 | 11/1990 | Ruehl et al. . | |

OTHER PUBLICATIONS

Pages entitled "Limitron KTN-R And KTS-R", Limitron KTK-R and T-TRON JJN And JJS from Full Line Catalog FLC Power Distribution Fuses, Jun. 1990, Bussmann Division, Cooper Industries.

*Primary Examiner*—Leo P. Picard
*Assistant Examiner*—Stephen T. Ryan
*Attorney, Agent, or Firm*— Burns, Doane, Swecker & Mathis, L.L.P.

[57] ABSTRACT

An fuse orientation device for an alarm indicating type fuse includes an orientation ring removably positionable on a cylindrical fuse body adjacent to a selected end having an axially extendable alarm indicator pin, and a fuse element holder having fuse mounting clips, a shoulder and receiving gap in the fuse holder allowing a fuse carrying the ring to be mounted in a particular orientation so that the indicator pin will cooperate with an alarm indicating circuit in the event the fuse element interrupts the circuit.

11 Claims, 2 Drawing Sheets

FUSE ORIENTATION DEVICE

FIELD OF THE INVENTION

The present invention relates to fuse holders or fuse carriers for alarm indicating fuse elements. More particularly, the present invention relates to a device for ensuring the correct orientation of an alarm, or fault, indicating fuse element installed in a fuse holder.

BACKGROUND AND SUMMARY OF THE INVENTION

Alarm indicating fuses provide an external signal, typically an audio alert such as buzzer, or a visual alert such as a lamp or a mechanical pin, that a circuit fault has occurred. Alarm indicating fuses are advantageous in systems where a large number of fuses are arrayed to protect various electrical circuits, or portions of circuits. Swiftly locating a circuit fault is important for the safety and operation of the system, and locating an individual circuit fault without an external fault indicator is slow and time consuming.

Alarm indicating fuses generally include a fuse element that cooperates with a fuse holder to activate a visual or audio signal when a circuit fault occurs. One type of fault indicating fuse element comprises a cartridge-type fuse element having an axially mounted pin in one head or ferrule of the fuse element. The pin extends from the fuse element when the fuse element interrupts the circuit because of a short circuit or an overcurrent condition. The pin contacts an electrical contact in the fuse holder to complete a circuit activating the fault indicator, e.g. a lamp or buzzer.

For the indicator alarm to function, the fuse element must be positioned in the fuse holder so that the end having the indicator pin is oriented with the alarm circuit contact in the fuse holder. The interrupting function itself of the fuse element is not affected by the orientation of the fuse element in the fuse holder, that is, an incorrectly oriented fuse element will succeed in interrupting a circuit in the event of a fault condition. In addition, non-indicating fuse elements of an appropriate rating can be used safely in alarm indicating fuse holders if the indicating function is relinquished.

The present invention provides a device to ensure quickly and reliably the correct orientation of an alarm indicating fuse element in a fuse holder. The device of the present invention provides both visual and mechanical means to correctly orient a fuse element in a fuse holder.

More particularly, the present invention provides an orientation ring that may be removably positioned on a fuse element and cooperates with a fuse element receiving space in a fuse holder to ensure that the fuse element is positioned in a selected orientation. An orientation ring in accordance with the present invention positioned on a fuse element creates a non-symmetrical appearance that corresponds to a non-symmetrical fuse element receiving space in a fuse holder to direct a user to orient correctly the fuse element.

The fuse element receiving space is configured to interfere with an orientation ring positioned on a fuse element which is incorrectly oriented, the receiving space preventing the fuse element holder from accepting the incorrectly oriented fuse element. Conversely, when the fuse element is correctly oriented, the fuse element receiving space accepts the fuse element and orientation ring without interference and allows the fuse element to be installed in the fuse element holder.

A fuse element holder according to the present invention does not prevent the installation of a fuse not carrying an orientation ring of the present invention. The fuse element holder of the present invention can therefore be used with non alarm indicating fuse elements if necessary.

The fuse orientation ring of the present invention is formed of a non-conducting material and does not comprise an electrically functional part of a fuse element on which the orientation ring is positioned. The orientation ring comprises an annular first portion having an inner diameter sufficient to accept therein a head, or ferrule, portion of a fuse element. A plurality of projections extend from the first portion from a plane defined by the first portion and angled toward a center of the first portion. Remote ends of the projections define a passage having an inner diameter smaller than the inner diameter of the first portion, and sufficiently large to accept therein a cylindrical body portion of a fuse element.

The fuse orientation ring of the present invention is positionable on a fuse element by inserting a head portion of the fuse element through the first portion from a side opposite the projections, and then past the projections, which deform to allow the head to pass. Once the head has passed, the projections recover their original position so that the remote ends engage a body portion of the fuse element to retain the orientation ring at a selected position on the fuse element.

Once positioned on a fuse element, the orientation ring, which has an outer diameter greater than an outer diameter of the fuse element, projects radially outward from the body of the fuse element. The fuse element holder is provided with fuse element mounting means that includes generally C-shaped fuse clips to retain the opposing head portions of the fuse element and provide electrical connection therewith to connect the fuse element in an electrical circuit.

The fuse clips are located in a fuse element receiving space that is configured to permit a fuse element carrying an orientation ring to be positioned in the mounting means in a selected orientation only. The fuse element receiving space is defined by a shoulder portion located at a selected end of the space adjacent to a fuse clip. The shoulder interferes with the orientation ring so that the head portion adjacent to an orientation ring cannot be inserted in the fuse clip mounting. At an opposing end of the receiving space, a relief gap adjacent to an opposing fuse clip provides sufficient space to accept the orientation ring and permit the head end adjacent to the orientation ring to be inserted in the fuse clip.

An incorrectly oriented fuse element may be partially received in the receiving space, wherein a head portion at the relief gap end is partially retained in the respective fuse clip, but the orientation ring interferes with the opposing end portion being positioned in the other fuse clip.

According to another aspect of the invention, the fuse element holder is positionable in a fuse housing. An aperture for receiving the fuse element holder prevents the insertion of a holder with an incorrectly oriented fuse element.

The orientation ring and the fuse element holder may include color coding to facilitate further visual means for orienting the fuse element in the fuse holder.

BRIEF DESCRIPTION OF THE DRAWING FIGURES

The present invention can be further understood with reference to the following description in conjunction with the appended drawings, wherein like elements are given the same reference numeral. In the drawings.

DETAILED DESCRIPTION OF PREFERRED EMBODIMENTS

Figure 1:
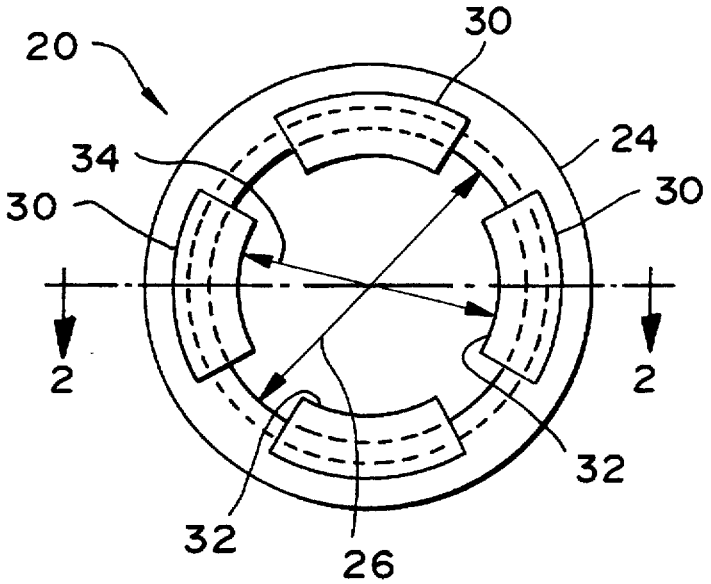
FIG. 1 is a top view of a fuse orientation ring in accordance with the present invention.
Figure 2:
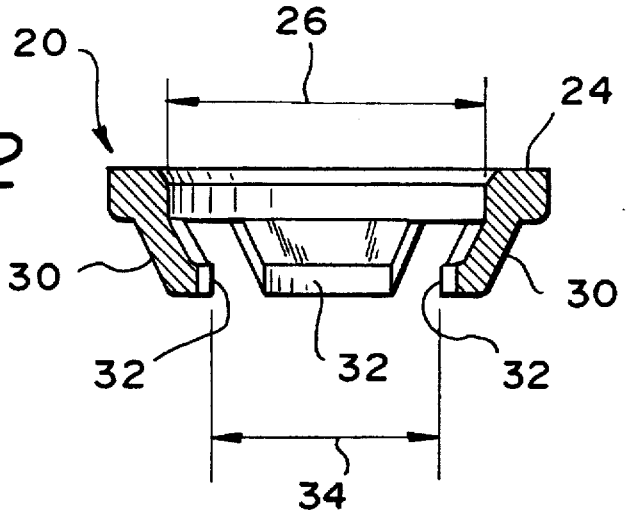
FIG. 2 is a side sectional view of the fuse orientation ring along the line 2—2 of FIG. 1.

FIG. 1 is a top view of an orientation ring 20 in accordance with a preferred embodiment of the present invention. FIG. 2 is a sectional view of the orientation ring taken along the line 2—2 of FIG. 1. The orientation ring 20 is formed of an electrically non-conducting material that is resilient and tough, for example a polymeric plastic.

The orientation ring 20 includes an annular first portion 24 that includes a centrally located hole 26. A plurality of projections 30 extend obliquely from the first portion 24 away from a plane defined by the first portion, as best illustrated in FIG. 2. The projections 30 are angled toward an axial center of the hole 26 so that remote ends 32 of the projections define a passage 34 that has a diameter smaller than the diameter of the hole 26.

Figure 3:
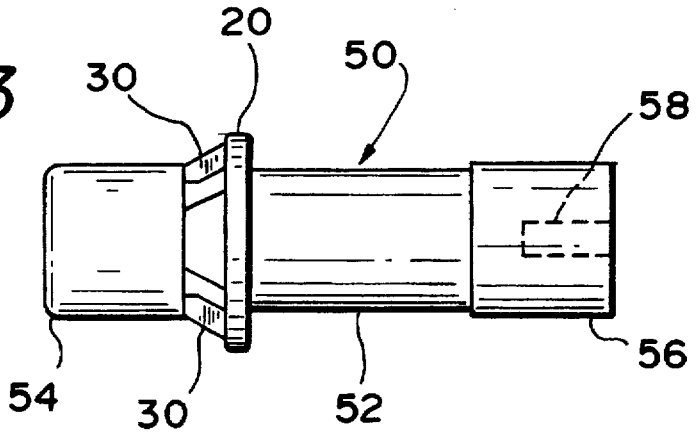
FIG. 3 is a elevation of a fuse orientation ring positioned on a fuse element.

FIG. 3 is a side elevation of a ring 20 positioned on a fuse element 50. The fuse element 50 shown has a generally cylindrically shaped body 52, and includes head portions 54, 56 at opposing ends of the body. The present invention also applies to differently shaped fuse elements, for example, fuse elements having elongated rectangular bodies, or having blade-shaped heads, and the particular fuse element described herein is illustrative. The head portions 54, 56 are electrically conducting and serve to connect the fuse element 50 in an electrical circuit. The head portions 54, 56 shown in FIG. 3 are slightly larger in diameter than the body portion 52, which is typical of cartridge type fuse elements.

The fuse element 50 is an alarm indicating type fuse element, and has an indicator pin 58 that is axially extendible from the head portion 56 in the event an overcurrent condition occurs and the fuse element interrupts the circuit.

Referring to FIG. 1 and FIG. 2, the centrally located hole 26 in the first portion 24 is sufficiently large to accept therethrough a head portion 54 of a fuse element 50. The passage 34 defined by the remote ends 32 of the projections 30 is sufficiently large to accommodate the body portion 52 of the fuse element 50 so that the remote ends of the projections contact the body portion and provide friction to retain the orientation ring 20 in a selected location on the body portion.

The orientation ring 20 is placed on a fuse element 50 by inserting a head portion 54 of the fuse element through the centrally located hole 26 from the side opposite the projections 30. The projections 30 deflect to allow the head portion 54 to pass and thereafter return to normal position to engage the body portion 52 of the fuse element 50. Friction between the remote ends 32 of the projections 30 and the body portion 52 permits the orientation ring 20 to be retained at a selected part of the body, and as shown, adjacent to the head portion 54.

The orientation ring 20 positioned on the fuse element 50 adjacent to a selected head portion 54 projects radially outward from the fuse element. The fuse element 50 carrying an orientation ring 20 as illustrated in FIG. 3 becomes non-symmetrical from one head portion 54 to the other head portion 56, which facilitates orienting the fuse element in a fuse element holder, as described below.

Figure 4:
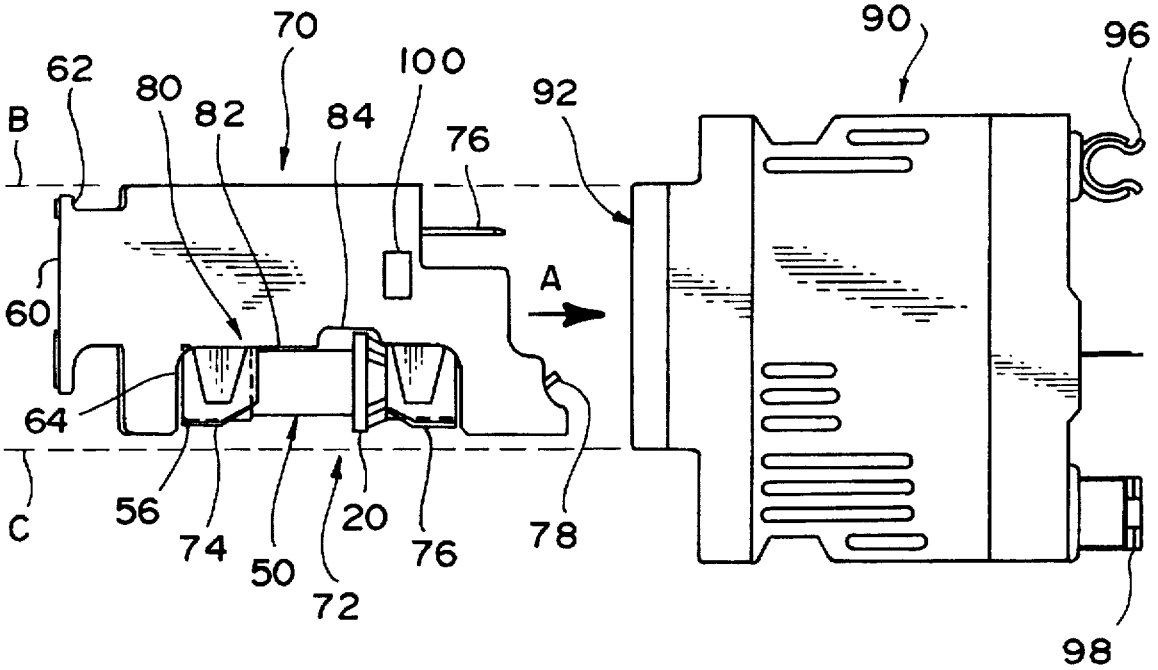
FIG. 4 is a side view of a fuse housing and a fuse element carrying an orientation ring correctly mounted in a fuse element holder; and, FIG. 5 is a side view of a fuse housing and a fuse element carrying an orientation ring incorrectly mounted in a fuse element holder.

FIG. 4 is a side view of a fuse element 50 carrying an orientation ring 20 and correctly installed in a fuse element holder 70. Also shown is a fuse housing 90, which is further described below. A fuse element holder 70 with an mounted fuse element 50 is inserted into an aperture 92 in the fuse housing 90 in the direction shown by arrow A. Correctly installed, the fuse element 50, fuse element holder 70 and fuse housing 90 form a fuse unit that is connected in an electrical circuit by connecting clips 96, 98. The fuse element holder 70 is removable from the fuse housing 90 to change a fuse element, as is necessary.

The fuse element holder 70 includes a space 72 for receiving the fuse element 50. The receiving space 72 includes mounting fuse clips 74, 76 for gripping and retaining the head portions 54, 56 of the fuse element 50 and electrically connecting the fuse element in the fuse element holder 70. The fuse clips 74, 76 are located at opposing ends of the receiving space 72 and are formed of electrically conductive, typically metallic, material.

The fuse element holder 70 includes an alarm indicator 60, a lamp or audible buzzer, provided in a handle portion 62 of the fuse holder. A contact 64 located adjacent to a fuse clip 74 is contacted by the pin 58 when in a position extending from the head portion 56. In the extended position, the pin 58 completes a circuit that powers the alarm indicator 60 to signal a circuit fault.

The fuse element receiving space 72 is defined by a wall 80 having a shoulder 82 at one end and a relief gap 84 at the opposing end. The relief gap 84 provides space for the orientation ring 20 to allow the fuse element 50 to be installed in the mounting.

Figure 5:
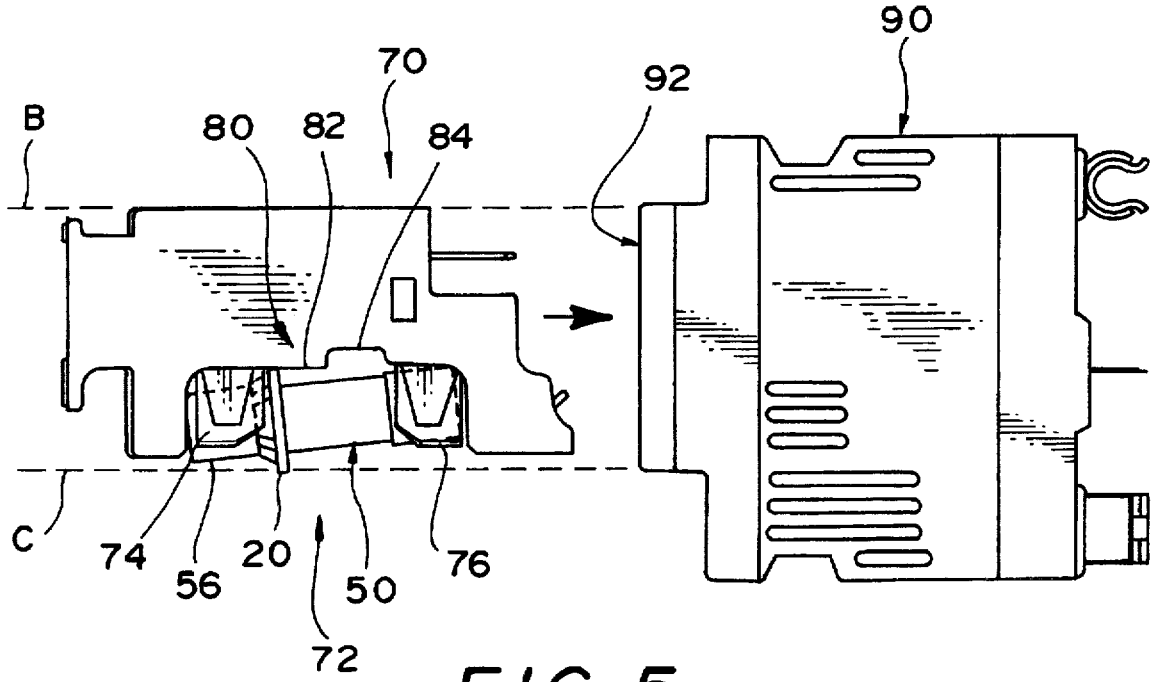

FIG. 5 is a side view of a fuse element 50 carrying an orientation ring 20 and incorrectly positioned in the fuse holder 70. The shoulder 82 provides interference with the orientation ring 20 when the fuse element 50 is incorrectly positioned to prevent the fuse element 50 being incorrectly mounted. As illustrated in FIG. 5, the incorrectly positioned fuse element 20 is partially gripped by the fuse clip 76, but extends from the receiving space 72.

Referring to FIGS. 4 and 5, the broken lines B and C indicate the size of the aperture 92 projected to the fuse holder 70. In FIG. 4, it can be seen that with a fuse element 50 correctly mounted in the fuse element holder 70, the fuse element holder 70 may be inserted in the aperture 92 of the housing 90. Conversely, if the fuse element 50 is incorrectly mounted, as shown in FIG. 5, the orientation ring 20 and part of the fuse head 56 extend from the fuse element receiving space 72, exceeding the aperture width. The orientation ring 20 in this position interferes with the fuse element holder 70 being inserted into the aperture 92. This provides an additional indication to the user that the fuse element 50 is not correctly mounted.

As an additional indicator for correct orientation of the fuse element 50, the orientation ring 20 may be colored, and a matching color bar 100 provided on the fuse element holder 70 at the appropriate end of the fuse element receiving space 72.

The foregoing has described the preferred principles, embodiments and modes of operation of the present invention; however, the invention should not be construed as limited to the particular embodiments discussed. Instead, the above-described embodiments should be regarded as illustrative rather than restrictive, and it should be appreciated that variations, changes and equivalents may be made by others without departing from the scope of the present invention as defined by the following claims.

What is claimed is:

1. A fuse orientation device for an alarm indicating fuse element of the type having an elongated body and electrical contact portions at opposing ends, the device comprising:

an orientation ring removably positionable on a body of a fuse element between end portions and axially adjacent to a selected end portion so that the orientation ring extends laterally from an outer surface of the fuse element, the orientation ring comprising a plurality of resilient projections to removably secure the ring on a body of a fuse element, the resilient projections extending obliquely from an annular portion of the ring, remote ends of the projections defining a fuse element engaging passage; and, a fuse element holder having mounting means for a fuse element to receive a fuse laterally inserted in the mounting means, the mounting means include a pair of spaced fuse clips for securing opposing head ends of a fuse element and means adjacent to a first fuse clip for interfering with the orientation ring secured to a fuse element to prevent an incorrectly oriented fuse element from being mounted to the fuse clips and means adjacent to a second fuse clip for receiving the orientation ring to allow a correctly oriented fuse element to be mounted to the fuse clips.

2. The fuse orientation device of claim 1, wherein the interfering means comprises a shoulder adjacent to the first fuse clip to interfere with the orientation ring positioned on a fuse element.

3. The fuse orientation device of claim 1, wherein the receiving means comprises a relief area adjacent to the second fuse clip to permit an end of a fuse element carrying the orientation ring to be accepted in the fuse clip.

4. The fuse orientation device of claim 1, further comprising a fuse housing having an aperture in which the fuse holder is inserted, the fuse housing being connectable in an electric circuit, the aperture preventing a fuse holder having an incorrectly positioned fuse element from being inserted.

5. The fuse orientation device of claim 1, wherein the interfering means contacts an outer lateral surface of the orientation device to prevent the lateral insertion of an incorrectly oriented fuse.

6. A fuse orientation device for an alarm indicating fuse element of the type having an elongated body and electrical contact portions at opposing ends, the device comprising:

an orientation ring removably positionable on a body of a fuse element between end portions and axially adjacent to a selected end portion so that the orientation ring extends laterally from an outer surface of the fuse element;

a fuse element holder having mounting means for a fuse element to receive a fuse laterally inserted in the mounting means, the mounting means including a pair of spaced fuse clips for securing opposing head ends of a fuse element and means adjacent to a first fuse clip for interfering with the orientation ring secured to a fuse element to prevent an incorrectly oriented fuse element from being mounted to the fuse clips and means adjacent to a second fuse clip for receiving the orientation ring to allow a correctly oriented fuse element to be mounted to the fuse clips; and, a fuse housing having an aperture in which the fuse holder is inserted, the fuse housing being connectable in an electric circuit, the aperture preventing a fuse holder having an incorrectly positioned fuse element from being inserted.

7. The fuse orientation device of claim 6, the orientation ring further comprising retaining means to removably secure the ring on a body of a fuse element.

8. The fuse orientation device of claim 4, wherein the retaining means comprises a plurality of resilient projections extending obliquely from an annular portion of the ring, remote ends of the projections defining a fuse element engaging passage.

9. The fuse orientation device of claim 6, wherein the interfering means comprises a shoulder adjacent the first fuse clip to interfere with the orientation ring positioned on a fuse element.

10. The fuse orientation device of claim 6, wherein the receiving means comprises a relief area adjacent to the second fuse clip to permit an end of a fuse element carrying the orientation ring to be accepted in the fuse clip.

11. The fuse orientation device of claim 6, wherein the interfering means contacts an outer lateral surface of the orientation device to prevent the lateral insertion of an incorrectly oriented fuse.

* * * * *